US006374540B1

(12) United States Patent
Garcia

(10) Patent No.: US 6,374,540 B1
(45) **Date of Patent: *Apr. 23, 2002**

(54) PLANT COVER/WRAP SYSTEM

(75) Inventor: Pedro F. Garcia, Atlanta, GA (US)

(73) Assignee: Southpac Trust International, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 09/504,497

(22) Filed: Feb. 15, 2000

Related U.S. Application Data

(63) Continuation of application No. 08/696,277, filed on Aug. 13, 1996, now abandoned, which is a continuation of application No. 08/174,991, filed on Dec. 28, 1993, now abandoned, which is a continuation of application No. 07/651,105, filed on Feb. 4, 1991, now Pat. No. 5,402,601, which is a continuation of application No. 07/416,344, filed on Oct. 3, 1989, now abandoned, which is a continuation-in-part of application No. 07/149,002, filed on Jan. 27, 1988, now abandoned.

(51) Int. Cl.[7] ..... A01G 9/02
(52) U.S. Cl. ..... 47/72
(58) Field of Search ..... 47/72; 220/495.07

(56) References Cited

U.S. PATENT DOCUMENTS

| | | | |
|---|---|---|---|
| 239,987 | A | 4/1881 | Shellenberger |
| 580,671 | A | 4/1897 | Perry |
| 681,066 | A | 8/1901 | Millingar |
| 716,668 | A | 12/1902 | Cheney |
| 732,889 | A | 7/1903 | Paver |
| 797,175 | A | 8/1905 | Collenburg |
| 923,663 | A | 6/1909 | Kroeger |
| 1,002,346 | A | 9/1911 | Weeks |
| 1,052,379 | A | 2/1913 | Ranken |
| 1,069,675 | A | 8/1913 | Claussen |
| 1,206,708 | A | 11/1916 | Hutchins |
| 1,293,316 | A | 2/1919 | Bogert |
| 1,421,027 | A | 6/1922 | Reynolds |
| 1,421,628 | A | 7/1922 | Watkins |
| 1,446,563 | A | 2/1923 | Hughes |
| 1,464,534 | A | 8/1923 | Lovett ..... 47/72 |

(List continued on next page.)

OTHER PUBLICATIONS

Exhibit H. "Speed cover®" Brochure, published in 1983 by Applicants, showing various pot cover for sale.
Exhibit I. "Speed Cover®" Brochure, published in 1983 by Applicants, showing various pot covers for sale.
Exhibit J. Item published in 1936 by Gellman, Bros., Minneapolis, MN. Shows an assortment of paper hats.
Exhibit M. "Speed Cover®" Brochure, published in 1984 by Applicants, showing various pot covers for sale.
Exhibit O. It is also known to shape a sheet of shape sustaining wrapping material, such as foil to a pot using a board with a central hole, the diameter being greater than the diameter of the pot, by pushing the pot through the hole pulling the wrapping through the hole so that the wrapping is gathered around the pot.

*Primary Examiner*—Peter M. Poon
*Assistant Examiner*—Son T. Nguyen
(74) *Attorney, Agent, or Firm*—Dunlap, Codding & Rogers, P.C.

(57) ABSTRACT

A cover/wrap system for flower pots and the like allows the use of any sheet of material to cover a pot and be held in place by a sleeve. A transparent sleeve can be used, and colored or patterned material will decorate the pot; and, if the material is subject to moisture damage, an inner sleeve acts as a moisture barrier. The sleeve can be set down, the sheet of material placed over the sleeve, and the pot simply placed on the sheet of material. The pot will sink into the sleeve and will urge the sheet of material around the pot, then hold the material in place.

8 Claims, 2 Drawing Sheets

U.S. PATENT DOCUMENTS

| | | | | |
|---|---|---|---|---|
| 1,693,435 | A | 11/1928 | Clarke | |
| 1,811,478 | A | 6/1931 | Seckendorf | 229/109 |
| 1,863,216 | A | 6/1932 | Wordingham | |
| 1,868,853 | A | 7/1932 | Sievers | |
| 1,920,533 | A | 8/1933 | Strause | 281/34 |
| 1,924,926 | A | 8/1933 | Gray | 65/53 |
| 1,951,642 | A | 3/1934 | Augustin et al. | 47/34 |
| 1,978,631 | A | 10/1934 | Herrlinger | 91/68 |
| 1,979,771 | A | 11/1934 | Potter | 47/41 |
| 2,076,212 | A | 4/1937 | Suter et al. | 91/67.9 |
| 2,123,075 | A | 7/1938 | Langa | 47/34 |
| 2,152,648 | A | 4/1939 | Jones | 47/34 |
| 2,240,599 | A | 5/1941 | Amberg | 229/1.5 B |
| 2,278,673 | A | 4/1942 | Savada et al. | 154/43 |
| 2,302,259 | A | 11/1942 | Rothfuss | 41/10 |
| 2,307,076 | A | 1/1943 | Ray | 229/109 |
| 2,317,554 | A | 4/1943 | Risch | 229/8 |
| 2,355,559 | A | 8/1944 | Renner | 229/8 |
| 2,411,328 | A | 11/1946 | MacNab | 33/12 |
| 2,482,981 | A | 9/1949 | Kamrass | 41/13 |
| 2,510,120 | A | 6/1950 | Leander | 117/122 |
| 2,529,060 | A | 11/1950 | Trillich | 117/68.5 |
| 2,540,707 | A | 2/1951 | Beukelman | 47/72 |
| 2,774,187 | A | 12/1956 | Smithers | 47/41 |
| 2,822,287 | A | 2/1958 | Avery | 117/14 |
| 2,827,217 | A | 3/1958 | Clement | 229/1.5 |
| 2,845,735 | A | 8/1958 | Werner | 41/10 |
| 2,925,208 | A | 2/1960 | Wood | 229/4.5 |
| 2,942,823 | A | 6/1960 | Chapman | 248/97 |
| 2,967,652 | A | 1/1961 | Canfield et al. | 229/5.5 |
| 3,013,689 | A | 12/1961 | Shropshire | 215/100.5 |
| 3,022,605 | A | 2/1962 | Reynolds | 47/58 |
| 3,052,063 | A | 9/1962 | Dunn | 46/72 |
| 3,094,810 | A | 6/1963 | Kalpin | 47/37 |
| 3,130,113 | A | 4/1964 | Silman | 161/97 |
| 3,271,922 | A | 9/1966 | Wallerstein et al. | 53/3 |
| 3,376,666 | A | 4/1968 | Leonard | 47/11 |
| 3,423,008 | A | 1/1969 | Mykleby | 229/10 |
| 3,488,022 | A | 1/1970 | Vittori | 248/152 |
| 3,508,473 | A | 4/1970 | Gill | 229/400 |
| 3,552,059 | A | 1/1971 | Moore | 47/41.12 |
| 3,554,434 | A | 1/1971 | Anderson | 229/55 |
| 3,620,366 | A | 11/1971 | Parkinson et al. | 206/59 C |
| 3,681,105 | A | 8/1972 | Milutin et al. | 117/15 |
| 3,748,781 | A | 7/1973 | Erling | 206/423 |
| 3,775,903 | A | 12/1973 | Pike | 47/37 |
| 3,869,828 | A | 3/1975 | Matsumoto | 47/34.11 |
| 3,910,328 | A | 10/1975 | Marcoux | 215/12.1 |
| 3,962,503 | A | 6/1976 | Crawford | 428/40 |
| 3,974,960 | A | 8/1976 | Mitchell | 229/62 |
| 3,980,225 | A | 9/1976 | Kan | 383/104 |
| 4,043,077 | A | 8/1977 | Stonehocker | 47/66 |
| 4,054,697 | A | 10/1977 | Reed et al. | 428/40 |
| 4,118,890 | A | 10/1978 | Shore | 47/28 R |
| 4,124,160 | A | 11/1978 | Meyers et al. | 47/72 |
| 4,170,618 | A | 10/1979 | Adams | 264/101 |
| D254,659 | S | 4/1980 | Karotseris | D11/143 |
| 4,216,620 | A | 8/1980 | Weder et al. | 47/72 |
| 4,250,664 | A | 2/1981 | Remke | 47/76 |
| 4,283,032 | A | 8/1981 | Smith | 248/97 |
| 4,297,811 | A | 11/1981 | Weder | 47/72 |
| 4,300,312 | A | 11/1981 | Weder et al. | 47/72 |
| 4,338,979 | A | 7/1982 | Dow | 141/10 |
| 4,340,146 | A | 7/1982 | Stratton | 215/100.5 |
| 4,380,564 | A | 4/1983 | Cancio et al. | 428/167 |
| 4,400,910 | A | 8/1983 | Koudstaal et al. | 47/84 |
| 4,413,725 | A | 11/1983 | Bruno et al. | 206/45.33 |
| 4,488,697 | A | 12/1984 | Garvey | 248/101 |
| 4,508,223 | A | 4/1985 | Catrambone | 206/423 |
| 4,621,733 | A | 11/1986 | Harris | 206/423 |
| D292,562 | S | 11/1987 | Weder et al. | D11/164 |
| D292,563 | S | 11/1987 | Weder et al. | D11/164 |
| D293,224 | S | 12/1987 | Weder et al. | D11/164 |
| D293,774 | S | 1/1988 | Weder et al. | D11/164 |
| D293,775 | S | 1/1988 | Weder et al. | D11/164 |
| 4,717,262 | A | 1/1988 | Roen et al. | 383/120 |
| 4,733,521 | A | 3/1988 | Weder et al. | 47/72 |
| 4,773,182 | A | 9/1988 | Weder et al. | 47/72 |
| 4,779,998 | A | 10/1988 | Wischusen | 383/104 |
| 4,795,601 | A | 1/1989 | Cheng | 264/138 |
| 4,835,834 | A | 6/1989 | Weder et al. | 29/525 |
| 4,980,209 | A | 12/1990 | Hill | 428/34.1 |
| 5,076,011 | A | 12/1991 | Stehouwer | 47/72 |
| 5,085,003 | A | 2/1992 | Garcia | 47/72 |

PLANT COVER/WRAP SYSTEM

CROSS REFERENCE TO RELATED APPLICATION

This application is a continuation of U.S. Ser. No. 08/696,277, filed Aug. 13, 1996, now abandoned entitled PLANT COVER/WRAP SYSTEM, which is a continuation of U.S. Ser. No. 08/174,991, filed Dec. 28, 1993, entitled PLANT COVER/WRAP SYSTEM, now abandoned, which is a continuation of U.S. Ser. No. 07/651,105, filed Feb. 4, 1991, entitled PLANT COVER/WRAP SYSTEM, now U.S. Pat. No. 5,402,601, which is a continuation of U.S. Ser. No. 07/416,344, filed Oct. 3, 1989, entitled PLANT COVER/WRAP SYSTEM, now abandoned, which is a continuation-in-part of U.S. Ser. No. 07/149,002, filed Jan. 27, 1988, entitled PLANT COVER/WRAP SYSTEM, now abandoned.

FIELD OF THE INVENTION

This invention relates generally to flower pot decorations, and is more particularly concerned with a flower pot cover, or wrapping system, and a method for utilizing the cover or wrap.

DESCRIPTION OF THE PREFERRED EMBODIMENTS

Figure 1:
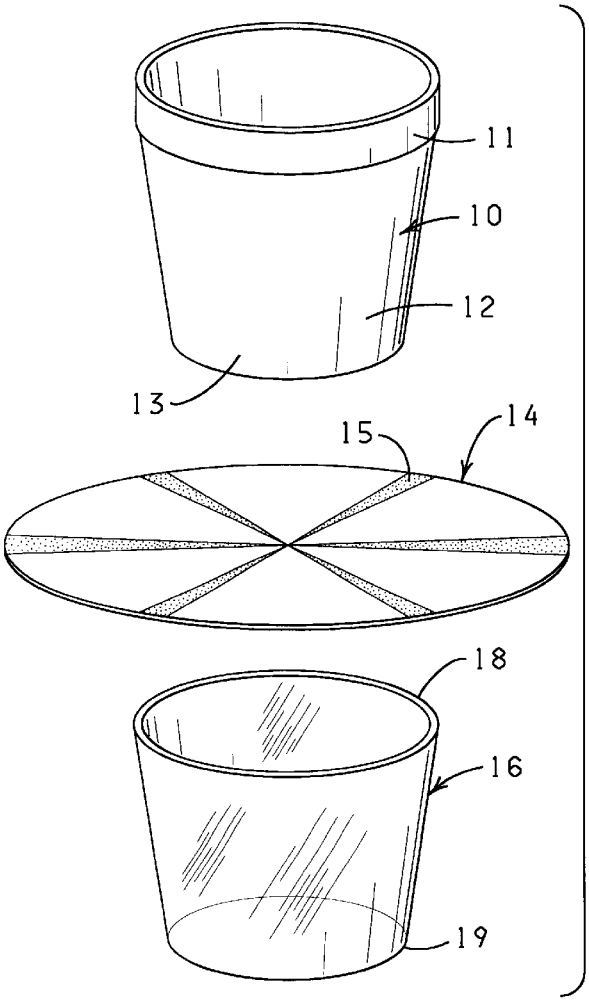
FIG. 1 is an exploded view illustrating the cover/wrap system of the present invention in conjunction with a generally conventional flower pot.

Referring now more particularly to the drawings, and to those embodiments of the invention here presented by way of illustration, FIG. 1 shows a generally conventional flower pot designated at 10, the flower pot 10 having a thicker rim 11 and a substantially frustoconical body portion 12. Those skilled in the art will understand that flower pots such as the pot 10 are frequently formed of terra cotta or other clay materials, and tend to be not particularly attractive for indoor use. It is therefore pots of this type that are normally covered by metal foil, perhaps with ribbons or the like for decoration.

In accordance with the present invention, a piece of sheet of material designated at 14 is utilized to cover the pot 10. As here shown, it is contemplated that the sheet of material 14 might be substantially circular, and might include a plurality of stripes or other printed design generally designated at 15. Furthermore, the sheet of material 14 will generally be a relatively flimsy material, for example a polyethylene film having a thickness in the vicinity of one mil. Polyethylene is mentioned only by way of example, and it will be readily understood by those skilled in the art that polypropylenes, polyethers, various vinyls and the like can be used equally well. While printability of the material is desirable, it will also be understood that the sheet of material 14 might be solid white and of a translucent nature, or might be dyed, either as a solid color or a marbleized, moiree or swirled pattern. Both to place the sheet of material 14 and to retain the sheet of material 14, there is a frustoconial sleeve generally designated at 16. The sleeve 16 is preferably transparent, and may be made of polystyrene or other inexpensive material. The upper, or larger diameter of the sleeve which is designated at 18 is sized to receive the pot 10 adjacent to the rim 11, while the lower end, and smaller diameter of the sleeve 16 designated at 19 is designed to receive the lower, or base portion of the pot 10 designated at 13.

Figure 2:
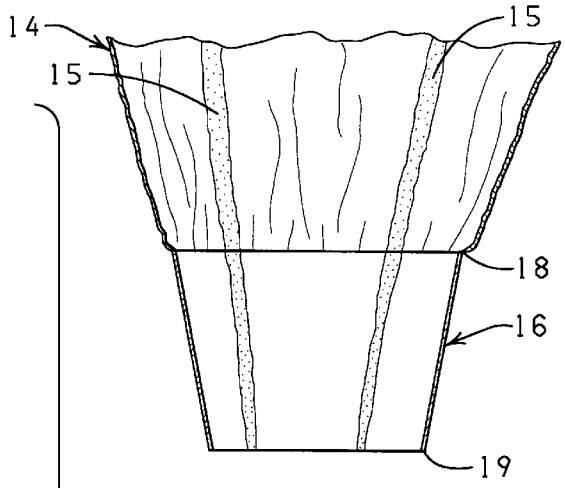
FIG. 2 is an elevational view showing the system of FIG. 1 assembled.
Figure 3:
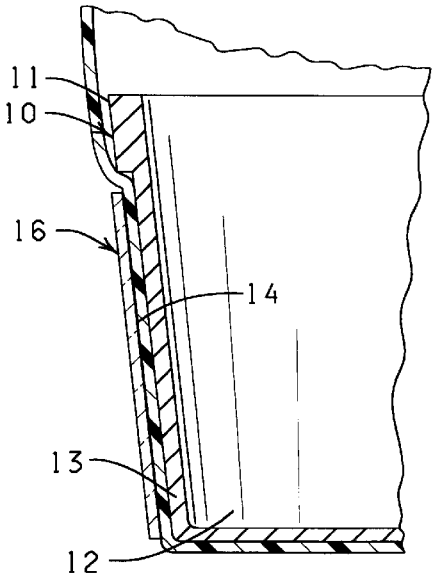
FIG. 3 is a fragmentary, enlarged cross-sectional view taken substantially along a radius of the device shown in FIG. 2 of the drawings.

With the above discussion in mind, attention is directed to FIGS. 2 and 3 of the drawings. While the sheet of material 14 is illustrated as substantially circular, it will be readily noted that virtually any other shape of material can also be used, the primary equipment being to have the sheet 14 large enough to cover the pot 10 substantially completely. Any additional material will extend beyond the pot 10 to cover the dirt plant roots and stems and the like, and is a matter of individual taste and decorating intent. It will therefore be understood that one can select a particular piece of sheet of material 14 to comport with the decorating scheme, and the sheet of material 14 can be somewhat casually laid across the end 18 of the sleeve 16. The pot 10 can then be placed over the sheet of material 14 and dropped into the sleeve 16. Since the sheet of material 14 is quite flexible, the sheet of material will pleat as necessary and fill the space between the sleeve 16 and the pot 10.

Once the pot 10 has been received completely within the sleeve 16 as shown in FIGS. 2 and 3, the sheet of material 14 can be further shaped if desired. By way of example, the material may be pulled upwardly as shown in FIG. 2, or half the material may be pulled up and the other half pulled down to achieve a different appearance. It will be understood, nevertheless, that this "shaping" will be done with little more than the brush of a hand and will not be particularly time consuming.

With the selected sheet of material 14 in place over the pot 10 as is illustrated in FIG. 2, it will be realized that a very attractive design has been achieved with a total investment of time of no more that a matter of seconds. By selections of inexpensive materials for the sheet of material 14 and the sleeve 16, the entire assembly can be very inexpensive to provide.

Figure 4:
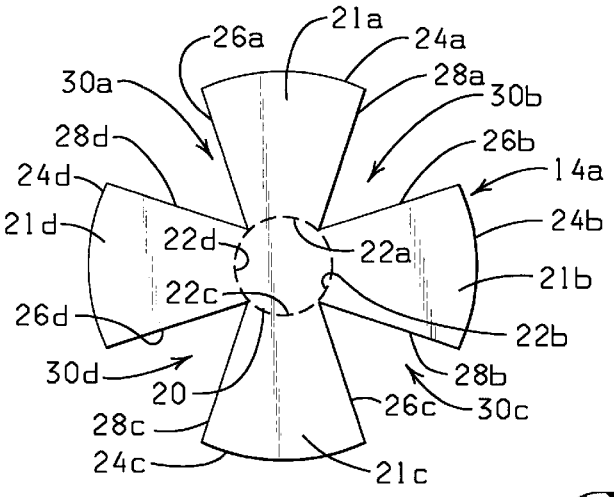
FIG. 4 is a plan view showing an alternate form of sheet of material for use with a system as shown in FIG. 1.

Shown in FIG. 4 is a modified sheet of material 14*a*. The sheet of material 14*a* may be somewhat heavier than discussed in conjunction with FIGS. 1, 2 and 3. The sheet of material 14*a* may be constructed of paper, foil, metalized paper, plastic material or virtually any other sheet of material desired for use as a flower pot cover.

The sheet of material 14*a* has a generally circularly shaped base 20 which corresponds to the size and shape of the flower pot 10 shown in FIG. 1. It should be noted that, although the base 20 has been shown as being generally circularly shaped in FIG. 4, the base could be any other shape such as square, rectangle, polygon or any other shape to conform to the shape of the bottom of the flower pot on which the cover made from the sheet of material 14*a* is to be used.

The sheet of material 14*a* has four segments 21, the four segments being designated in FIG. 4 by the respective numerals 21*a*, 21*b*, 21*c* and 21*d*. Each of the segments 21 is generally trapezoidal shaped and has opposite ends 22 and 24 and opposite sides 26 and 28. The opposite ends and the opposite sides of the segments 21 are designated with identical reference numerals, except the reference numerals as shown in FIG. 4 are followed by the respective letter designations "a", "b", "c" and "d" for the respective segments 21*a*, 21*b*, 21*c* and 21*d*. A generally triangularly shaped notch 30 is formed between each pair of segments 21 so that the side 28 of one of the segments 21 is spaced a distance from the side 26 of the adjacent segment 21. The respective notches are designated in FIG. 4 with the reference numerals 30*a*, 30*b*, and 30*c* and 30*d*. The segments 21 are shaped and sized so that when the segments are folded upwardly from the base 20, a portion of the side 28 of each of the segments generally overlaps a portion of the adjacent segment 21 generally along the side 26 thereof.

Using the sheet of material 14*a*, the sheet of material is positioned over the upper end 18 of the sleeve 16 (shown in FIG. 1) with the base 20 being disposed generally over and encompassing the upper end 18 of the sleeve 16. In this position of the sheet of material, the flower pot 10 is lowered into the sleeve 16. As the pot 10 is lowered in the sleeve 16, the segments 21 are folded upwardly about the outer peripheral surface of the flower pot 10 in a manner similar to that described before with respect to the sheet of material 14. However, rather than requiring the pleating as discussed above in conjunction with FIGS. 1 and 2, the notches 30 provide sufficient relief so that the sheet of material will not be appreciably pleated. As the flower pot 10 is covered by the sleeve 16, the segments 21 will be urged upwardly and the adjacent edges 28 and 26 of adjacent segments 21 will be slightly overlapped and the entire outer peripheral surface of the flower pot 10 will be covered by the sheet of material 14*a* with the base 20 covering the lower end or bottom 13 of the flower pot 10 and the segments 21 each extending upwardly over a portion of the outer peripheral surface of the flower pot 10.

It will therefore be understood by those skilled in the art that quite different appearance can be achieved on the flower pot 10 since various papers, heavy plastics, metalized papers, or plastics can be utilized, and even a heavy foil can be utilized. The speed of assembly of the plant cover/wrap system renders the system much more economical than the conventional, prior art systems.

Figure 5:
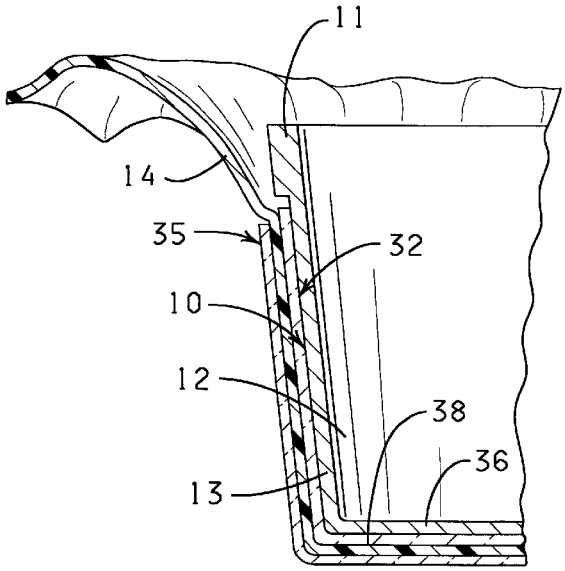
FIG. 5 is a view similar to FIG. 3 but showing a modified form of the invention.

In the system discussed hereinabove, it is contemplated that the sheet of material 14 or 14*a* will be resistant to moisture. It will be understood, however, that one might occasionally wish to utilize a sheet of material that cannot tolerate the moisture that will be present on the outside surface of the flower pot 10. by way of example, one might use painted or printed material on which the colors are not fast, or might utilize very fine fabrics or the like for an exceptionally luxurious appearance. For such an arrangement, the apparatus shown in FIG. 5 will be utilized. In FIG. 5, the pot is again designated at 10 with the rim 11, pot portion 12 and bottom 13. In FIG. 5 it will be seen that there is an inner sleeve 32 covering the pot portion 12 of the flower pot 10. Next to the inner sleeve 32 is the sheet of material designated at 14; and, to hold the sheet of material 14 in place, there is an outer sleeve 35.

As shown in FIG. 5, it will be seen that the bottom 36 of the flower pot 10 is also covered by a bottom portion 38 of the inner sleeve 32. Thus, the entire pot portion 12 of the flower pot 10 is covered by the inner sleeve 32 to prevent the passage of moisture from the pot 10 to the sheet of material 14. Similarly, as here shown the sleeve 35 includes a bottom portion 39. It will be obvious to those skilled in the art that the bottom portion 39 can be omitted,ed, but the flower pot 10 would then be resting on the sheet of material 14. This may not be objectionable since the inner, sleeve, 32 includes the bottom portion 38 to protect the sheet of material 14 from moisture.

In using the system shown in FIG. 5 of the drawings, it will be understood that the system will be substantially the same as that discussed above. The outer sleeve 35 will have the sleeve material 34 placed thereover. One will then place the flower pot 10 into the inner sleeve 32; and, the covered flower pot can then be set into the outer sleeve 35, allowing the sheet of material 34 to be pleated as necessary to fill the space between the inner sleeve 32 and the outer sleeve 35. It will further be understood that a substantially circular piece of sheet of material such as the material 14 can be utilized, or a heavier, notched piece of sheet of material such as the sheet of material 14*a* can be utilized in the arrangement in FIG. 5 of the drawings.

It will therefore be seen that the present invention provides a very quick and easy flower pot cover/wrap system that can be used with inexpensive sheet of materials for decoration, and the sheet of material can be printed with various designs, or be a solid color, and can even be transparent if such an effect is desired. Through the use of the sleeve 35, installation of the sheet of material such as the material 14 will be very quick, taking only a few seconds for complete covering of the pot such as the flower pot 10. Heavy sheet of materials can be used by utilizing the arrangement shown in FIG. 4 of the drawings, and delicate fabrics and the like can be utilized by using the inner sleeve 32 in conjunction with the outer sleeve 16 or 35.

Figure 6:
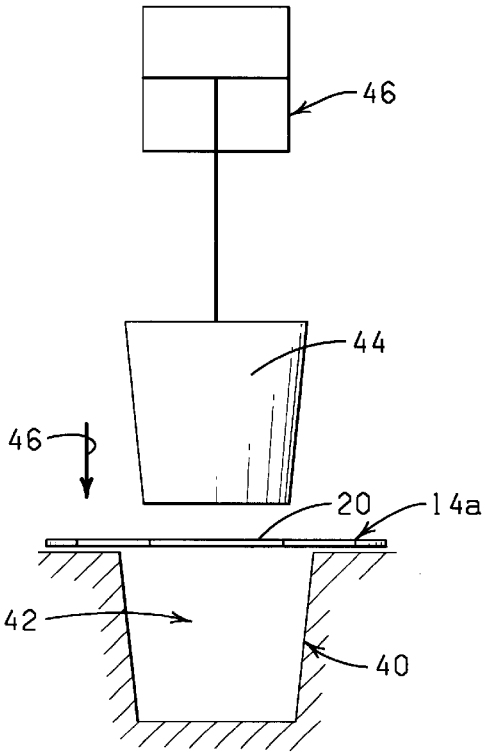
FIG. 6 is a partial sectional, partial elevational view illustrating one way to form a flower pot cover using the modified sheet of material shown in FIG. 4.

Shown in FIG. 6 is one system which may be used for forming a flower pot cover using the segmented sheet of material shown in FIG. 4. As shown in FIG. 6, the sheet of material 14*a* is positioned generally above a female mold 40 having a mold opening 42 in a position wherein the base 20 of the sheet of material 14*a* is positioned generally over the female mold opening 42 and the segments 21 each extend outwardly therefrom. A male mold 44 is connected to a cylinder rod of a hydraulic cylinder 46. The male mold 44 is shaped to be matingly disposed in the female mold 40.

Figure 7:
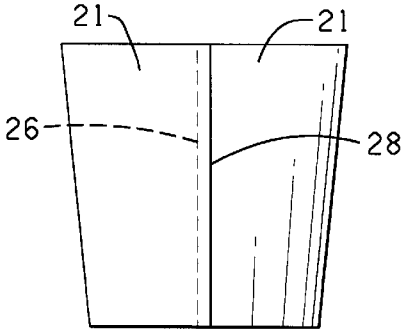
FIG. 7 is a side elevational view of a flower pot cover formed using the sheet of material shown in FIG. 4.

In operation, the hydraulic cylinder 46 is actuated to moved the male mold 44 in the downward direction 48 to a position wherein the lower end of the male mold engages the base 20 of the sheet of material 14*a*. The male mold 44 further is moved in the downward direction pushing the base 20 and the segments 21 connected thereto into the female mold 40. As the sheet of material 14*a* is pushed into the female mold the segments are formed in an upward direction extending generally upwardly from the base 20. As mentioned before, the segments 21 are shaped so that, when the segments have been moved in the upward direction and the male mold 44 is matingly disposed in the female mold 40, a portion of the side 28 of each of the segments 21 overlaps an adjacent portion of the side 26 of the adjacent segment. The sides 28 and 26 of each of the segments 21 are connected to form the decorative cover 50 as shown in FIG. 7. The overlapping edges 26 and 28 may be sealingly connected by heat sealing when the cover is formed from a heat sealable material such as polypropylene for example. In other instances, it may be necessary to connect the overlapping sides 26 and 28 by adhesively connecting the overlapping portion of the sides 26 and 28 of each of the segments 21.

Changes may be made in the construction of the various parts, elements and assemblies described herein and changes may be made in the steps or the sequence of steps of the methods described herein without departing from the spirit and scope of the invention as defined in the following claims.

What is claimed is:

1. A method of forming a covering for a flower pot having a bottom, the method comprising:

providing an inner sleeve having an opening sized to receive at least the lower end of the flower pot and configured to cover at least a portion of the outer peripheral surface of the flower pot, the inner sleeve having a closed bottom portion adapted to cover the bottom of the flower pot when the flower pot is disposed in the inner sleeve;

providing an outer sleeve having an opening sized to receive the inner sleeve;

placing a sheet of material having a base and at least two spaced apart segments between the closed bottom portion of the inner sleeve and the opening of the outer sleeve, a notch being formed between each pair of adjacent segments when the sheet of material is in an unfolded condition, each segment having a first end, a second end opposite the first end, a first side and a second side, the first end of each segment being connected to the base; and pressing the inner sleeve into the opening of the outer sleeve so that the sheet of material is disposed between the inner sleeve and the outer sleeve with the segments of the sheet of material urged upwardly such that a portion of the segments extends from the inner sleeve and the outer sleeve and the inner sleeve and the portion of the sheet of material extending upwardly from the inner sleeve and the outer sleeve are adapted to receive and cover the flower pot.

2. The method of claim 1 wherein in the pressing step, the segments of the sheet of material are urged upwardly such that each segment near the first side thereof overlaps a portion of the adjacent segment near the second side of the adjacent segment.

3. The method of claim 1 wherein in the step of providing the outer sleeve, the outer sleeve has a closed bottom portion adapted to cover the bottom portion of the inner sleeve when the inner sleeve is disposed in the outer sleeve.

4. The method of claim 1 wherein in the step of providing the outer sleeve, the outer sleeve is transparent.

5. A method of covering a flower pot having an upper end, a lower end, a bottom, and an outer peripheral surface, the method comprising the steps of:

providing an inner sleeve having an opening sized to receive at least the lower end of the flower pot and configured to cover at least a portion of the outer peripheral surface of the flower pot, the inner sleeve having a closed bottom portion adapted to cover the bottom of the flower pot when the flower pot is disposed in the inner sleeve;

providing an outer sleeve having an opening sized to receive the inner sleeve;

placing a sheet of material having a base and at least two spaced apart segments between the closed bottom portion of the inner sleeve and the opening of the outer sleeve, a notch being formed between each pair of adjacent segments when the sheet of material is in an unfolded condition, each segment having a first end, a second end opposite the first end, a first side and a second side, the first end of each segment being connected to the base;

pressing the inner sleeve into the opening of the outer sleeve so that the sheet of material is disposed between the inner sleeve and the outer sleeve with the segments of the sheet of material urged upwardly such that a portion of the segments extends from the inner sleeve and the outer sleeve; and placing the flower pot into the opening of the inner sleeve whereby the inner sleeve and the portion of the segments extending from the inner sleeve and the outer sleeve substantially cover the outer peripheral surface of the flower pot.

6. The method of claim 5 wherein in the pressing step, the segments of the sheet of material are urged upwardly such that each segment near the first side thereof overlaps a portion of the adjacent segment near the second side of the adjacent segment.

7. The method of claim 5 wherein in the step of providing the outer sleeve, the outer sleeve has a closed bottom portion adapted to cover the bottom portion of the inner sleeve when the inner sleeve is disposed in the outer sleeve.

8. The method of claim 5 wherein in the step of providing the outer sleeve, the outer sleeve is transparent.

* * * * *

UNITED STATES PATENT AND TRADEMARK OFFICE

CERTIFICATE OF CORRECTION

PATENT NO. : 6,374,540 B1 
APPLICATION NO. : 09/504497
DATED : April 23, 2002
INVENTOR(S) : Pedro F. Garcia It is certified that error appears in the above-identified patent and that said Letters Patent is hereby corrected as shown below:

Page 2:
U.S. PATENT DOCUMENTS, delete "3,508,473" and substitute therefore --3,580,473--.

In the Drawings:
Delete Figs. 6 and 7 and substitute new Figs. 6 and 7 as follows:

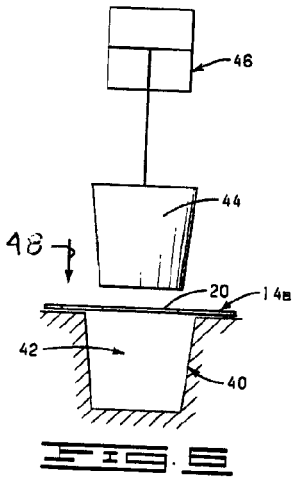

FIG. 6

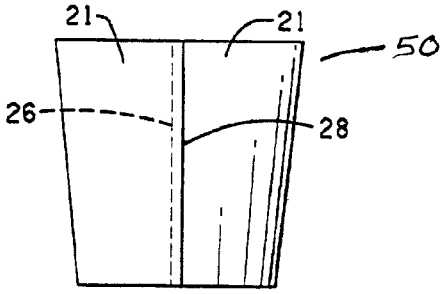

FIG. 7

Column 1:
Line 59, delete "of" and substitute therefore --or--.
Column 2:
Line 11, delete "The" and substitute therefore --An--.
Line 13, delete "the" and substitute therefore --a--.
Line 13, delete "and" and substitute therefore --or--.
Line 15, delete "the" and substitute therefore --a--.
Line 21, delete "equipment" and substitute therefore --requirement--.
Line 29, after the first occurrence of "the" and before "end" add --upper--.
Line 32, after "material" and before "will" add --14--.
Column 3:
Line 13, delete the first occurrence of "and".
Line 35, delete "end or bottom" and substitute therefore --or base portion--.
Line 40, after "quite" and before "different" add --a--.
Line 51, delete "by" and substitute therefore --By--.
Line 57, delete "pot" and substitute therefore --body--.
Line 57, delete "bottom" and substitute therefore --base portion--.
Line 58, delete "pot" and substitute therefore --body--.
Line 62, delete "the" and substitute therefore --a--.
Line 64, delete "pot" and substitute therefore --body--.

UNITED STATES PATENT AND TRADEMARK OFFICE

CERTIFICATE OF CORRECTION

PATENT NO. : 6,374,540 B1
APPLICATION NO. : 09/504497
DATED : April 23, 2002
INVENTOR(S) : Pedro F. Garcia It is certified that error appears in the above-identified patent and that said Letters Patent is hereby corrected as shown below:

Column 4:
Line 2, delete "omitted,ed," and substitute therefore --omitted,--.
Line 4, delete both occurrences of ",".
Line 10, delete "sleeve material 34" and substitute therefore --sheet of material 14--.
Line 13, delete "34" and substitute therefore --14--.
Line 16, after "the" and before "material" add --sheet of--.
Line 35, after "material" add --14a--.
Line 44, delete "moved" and substitute therefore --move--.
Line 45, after "mold" and before "engages" add --44--.
Line 47, after "direction" and before "pushing" add --48--.
Line 50, after "mold" and before "the" add --40--.
Line 50, after "segments" and before "are" add --21--.
Line 56, after "segment" add --21--.
Line 58, delete "the" and substitute therefore --a--.

Signed and Sealed this

Twenty-ninth Day of April, 2008

JON W. DUDAS
*Director of the United States Patent and Trademark Office*